US005112058A

United States Patent [19]

Sandeen

[11] Patent Number: 5,112,058

[45] Date of Patent: May 12, 1992

[54] GAME CARD

[76] Inventor: Lowell Sandeen, Rte. 1, Box 159, McIntosh, Minn. 56556

[21] Appl. No.: 610,847

[22] Filed: Nov. 8, 1990

[51] Int. Cl.[5] ..... A63F 3/06

[52] U.S. Cl. ..... 273/269; 273/139; 283/901; 283/903

[58] Field of Search ..... 273/139, 269, 272, 273, 273/294, 299; 283/903, 49, 102

[56] References Cited

U.S. PATENT DOCUMENTS

| | | | |
|---|---|---|---|
| 1,558,165 | 10/1925 | Haswell | 273/294 |
| 2,228,180 | 1/1941 | Pauli | 273/273 |
| 4,191,376 | 3/1980 | Goldman et al. | 273/139 |
| 4,491,319 | 1/1985 | Nelson | 273/139 |
| 4,611,811 | 9/1986 | Haase | 273/237 |
| 4,671,512 | 6/1987 | Bachman et al. | 273/139 |
| 4,830,380 | 5/1989 | Six | 273/269 |

FOREIGN PATENT DOCUMENTS

| | | | |
|---|---|---|---|
| 1805455 | 8/1969 | Fed. Rep. of Germany | 273/294 |
| 1599305 | 9/1981 | United Kingdom | 273/273 |
| 2190599 | 11/1987 | United Kingdom | 273/269 |

*Primary Examiner*—Benjamin Layno
*Attorney, Agent, or Firm*—Lawrence M. Nawrocki

[57] ABSTRACT

A game card for playing rounders or bingo. The game card comprises a matrix having a plurality of polygons interfitted to define a multiplicity of intersections formed by adjacent angular portions of contiguous polygons. Each angular portion of a polygon carries a number or a blank with no number. Alternatively, the game card may also be used for promotional purposes by covering the intersections and numbers surrounding the intersections with a removable opaque coating.

4 Claims, 5 Drawing Sheets

*Fig. 1*

| | | | | |
|---|---|---|---|---|
| 12345 | 21345 | 31245 | 41235 | 51234 |
| 12354 | 21354 | 31254 | 41253 | 51243 |
| 12435 | 21435 | 31425 | 41325 | 51324 |
| 12453 | 21453 | 31452 | 41352 | 51342 |
| 12534 | 21534 | 31524 | 41523 | 51423 |
| 12543 | 21543 | 31542 | 41532 | 51432 |
| 13245 | 23145 | 32145 | 42135 | 52134 |
| 13254 | 23154 | 32154 | 42153 | 52143 |
| 13425 | 23415 | 32415 | 42315 | 52314 |
| 13452 | 23451 | 32451 | 42351 | 52341 |
| 13524 | 23514 | 32514 | 42513 | 52413 |
| 13542 | 23541 | 32541 | 42531 | 52431 |
| 14235 | 24135 | 34125 | 43125 | 53124 |
| 14253 | 24153 | 34152 | 43152 | 53142 |
| 14325 | 24315 | 34215 | 43215 | 53214 |
| 14352 | 24351 | 34251 | 43251 | 53241 |
| 14523 | 24513 | 34512 | 43512 | 53412 |
| 14532 | 24531 | 34521 | 43521 | 53421 |
| 15234 | 25134 | 35124 | 45123 | 54123 |
| 15243 | 25143 | 35142 | 45132 | 54132 |
| 15324 | 25314 | 35214 | 45213 | 54213 |
| 15342 | 25341 | 35241 | 45231 | 54231 |
| 15423 | 25413 | 35412 | 45312 | 54312 |
| 15432 | 25431 | 35421 | 45321 | 54321 |

*Fig. 2*

1, 2, 3, 4, 5
11, 12, 13, 14, 15
22, 23, 24, 25
33, 34, 35
44, 45
55
111, 112, 113, 114, 115
122, 123, 124, 125
133, 134, 135
144, 145
155
222, 223, 224, 225
233, 234, 235
244, 245
255
333, 334, 335
344, 345
355
444, 445
555

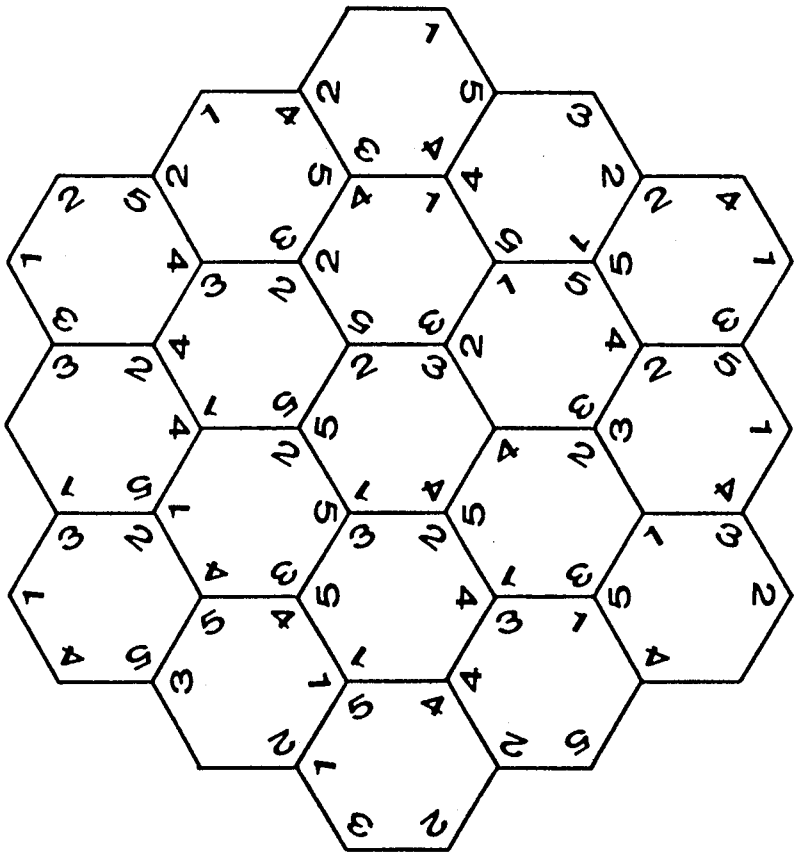
Fig. 4b
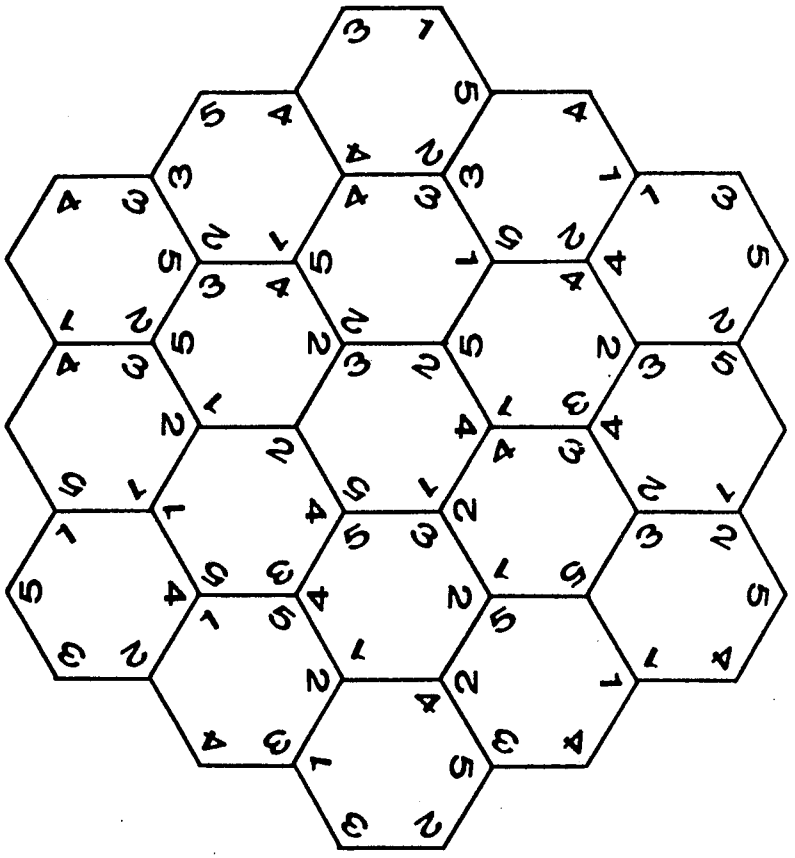
Fig. 4a
Fig. 4c
4-5-11-12-24-25-45-115-125-144-155-223-233-244-345

GAME CARD

BACKGROUND OF THE INVENTION

1. Field of the Invention

This invention is in the field of games. More specifically, this invention is in the field of games employing cards having pre-arranged numbers and figures thereon. Yet more specifically, this invention is in the field of game cards having pre-arranged indicia thereon, the indicia deployed in association with selected polygonal matrices having translation symmetry. Yet more specifically, this invention is in the field of a game called "rounders". This invention may also be used in a method of play analogous to that of bingo. Lastly, in another aspect of the present invention, the present game card is employed in a method wherein portions are "scraped off" to reveal numbers thereunder.

2. Description of the Prior Art

U.S. Pat. Nos. 4,191,376 ("Goldman et al."), 4,491,319 ("Nelson") and 4,671,512 ("Bachman et al.") relate to a latter aspect of the present invention, namely, its utilization in a "scrape-off" game playing method. Goldman et al. describes a game ticket and method of fabricating same used in, for example, a state lottery. A particular variety of lottery ticket and a security system relating thereto are disclosed.

Nelson discloses a game card device which provides an apparatus for a player to play a game of skill. Nelson employs removable opaque coatings to hide, in the first instance, the relationship is between a first plurality of figures as viewed from a first plane and, in the second instance, the relationship is between the figures as viewed from a second plane.

Bachman et al. discloses an automated teller machine receipt having a promotional game on the back side thereof. A selectively removable opaque masking is applied for game indicia on the back side of the ATM receipt.

U.S. Pat. No. 4,611,811 ("Haase") describes a bingo game having the ability to change part of the bingo pattern. Specifically, Haase discloses manual and electronic embodiments of his improved bingo game wherein the player is permitted to change the bingo pattern while the game is being played by rotating (either manually or electronically) the sixteen squares located in groups of four at each of four corners of the card.

U.S. Pat. No. 4,830,380 (Six) discloses an apparatus method and sheet which permits a vastly increased number of bingo cards to be printed and distributed without duplication.

None of the above disclosures, alone or in combination, discloses or suggests either the article or the method of the present invention.

SUMMARY OF THE INVENTION

Briefly, one aspect of the present invention is a game card device comprising a matrix or array defined by connected lines and intersections with numeric indicia and blanks thereon. The matrix has a generally closed perimeter. The matrix of the present invention also has two and three-line peripheral or perimeter intersections and three-line internal intersections. At or between the two and three-line intersections, randomly-selected numbers and blanks are printed (or omitted) so that each individual intersection is uniquely designated by a combination of blanks and numbers.

In a preferred aspect of the invention, the matrix is formed using a polygon having translational symmetry. Translational symmetry, as used herein, simply means that an internally closed array may be generated by sequentially moving the polygon in two dimensions. For example, a pentagon does not have translational symmetry. Multiple polygons are used to define the matrix which may have essentially any desired peripheral shape. For example, squares and hexagons can be chosen and employed to generate a game card device of the present invention.

Another aspect of this invention is a gaming method employing the above device. In this method, numbers are generated corresponding to the numerals and blanks on the device. As the numbers are generated, the intersection having the numbers are removed (in the same fashion) from said play. Victory is achieved when the covered intersections comprise a circle.

In yet another aspect of this invention, the above device is employed in a promotional method wherein all, or portions of, the intersections described are covered with an opaque, removable coating or material. The numbers at the various intersections or interstices are obscured by the removable opaque material. In the method of play, a particular number combination is desigated as a win. The player then successfully wins (and receives the prize offered in the promotion) when he or she removes the opaque material over an intersection having the pre-designated winning combination.

BRIEF DESCRIPTION OF THE DRAWING

FIG. 1 is a listing of number combinations that can be used to form patterns of the present invention.

FIG. 2 is a listing of the numbers that can be randomly drawn if the device of the present invention were used to play the game of "ringer".

FIGS. 4*a* and 4*b* illustrate modes of play using a device of the present invention which is more completely described below.

FIG. 4*c* lists the random numbers drawn to illustrate the mode of play depicted in FIGS. 4*a* and 4*b*.

DETAILED DESCRIPTION OF THE INVENTION

FIG. 1 illustrates the unique number combinations possible using five individual numbers and "blanks" for distribution around the intersections or vertices of the preferred polygon, that is, a hexagon. It will be understood that other geometric shapes are also contemplated. For example, the invention envisions matrices made up of contiguous squares, triangles, etd. An array of numbers depicted in FIG. 1 are individually unique in combination which could be used in numbering an array or matrix of hexagons. Hexagons individually have six intersections, all internal hexagonal members have intersections of three lines while peripheral members have an intersection of two lines.

Implicit in the list of numbers shown in FIG. 1 is a blank, since each have number arrays when placed on the six vertices of a hexagon would, of necessity, provide such a blank. An array of hexagons in a particular shape could be numbered by picking combinations from FIG. 1 in some regular fashion, that is, proceeding from left to right horizontally across the vertical columns or, in the alternative, down the vertical column of numbers, a blank being inserted at each sixth intersection. By application of the numbers listed in FIG. 1, several matrices of the size shown in FIGS. 3*a*, 3*b*, 4*a* and 4*b* could be numbered. Moreover, by designation of a "top" on a particular game card device, a symmetric matrix could be rotated so that the number array would appear quite different even though the only actual difference would be a rotation from one matrix to another. This same effect could be achieved by using the numbers listed in FIG. 1 and simply starting the numbering process at different points of a given symmetric matrix.

FIG. 2 is an array of numbers that would be used, for example, to generate the random listing of numbers for a game of "ringer". For example, the numbers listed in FIG. 2 could be affixed to ping-pong balls. The numbers could then be randomly selected and read to the participants in the game. As the numbers are read, the intersections having numbers corresponding to the numbers read would be blocked out, removed, circled, or marked in some fashion indicating that they had been removed from play. Alternatively, the array of numbers shown in FIG. 2 could be stored in a computer and generated in random order. In this fashion, a small portable game apparatus would be obtained. The apparatus would comprise a game card device of this invention and a computer-based, random number generator with appropriate auxiliary electronics.

Figure 3B:
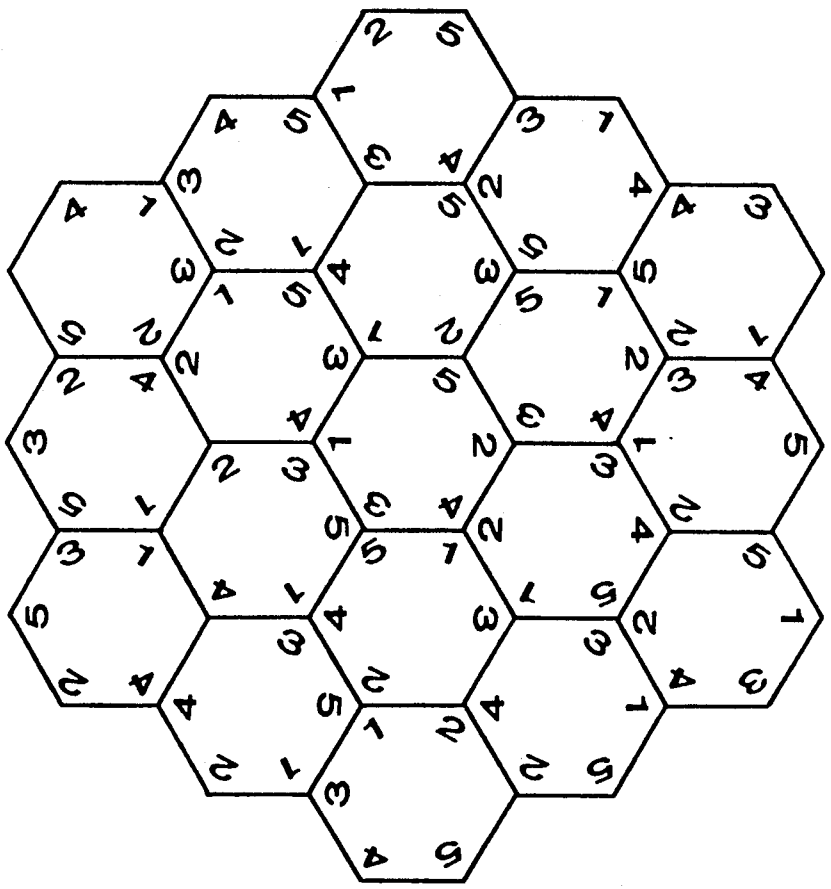
FIGS. 3*a* and 3*b* are matrices of the present invention.
Figure 3A:
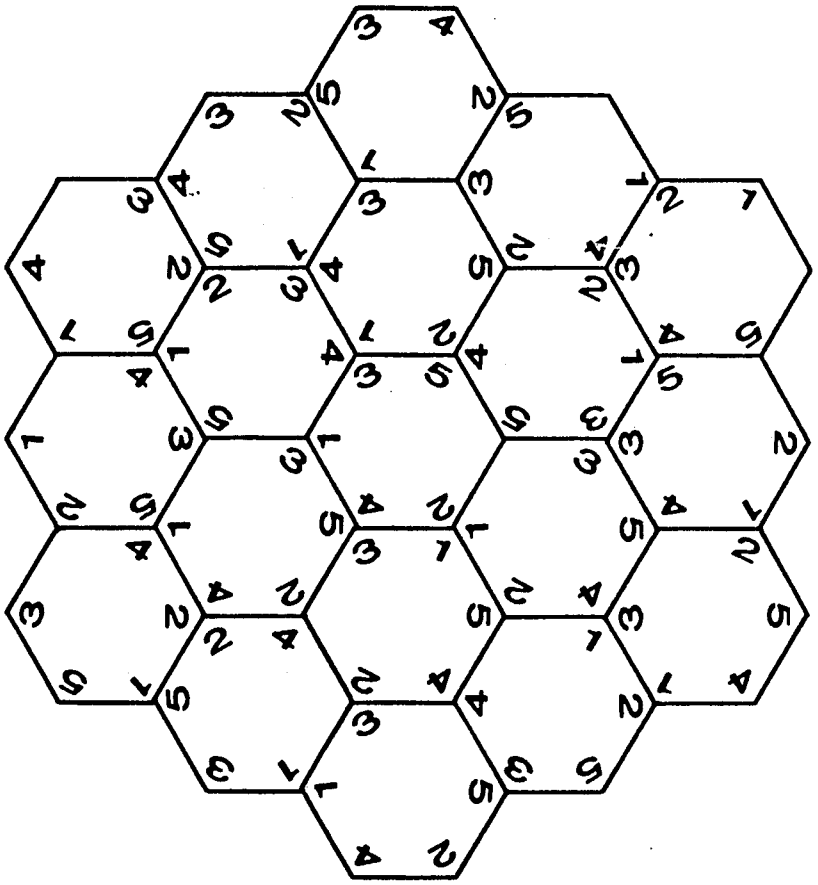

FIGS. 3*a* and 3*b* illustrate two number arrays, or matrices, of the present invention comprised of nineteen individual hexagons. Arrays 3*a* and 3*b* could be drawn and numbered by an appropriately programmed computer. Moreover, using the same principles, arrays with 37, 61, 96 or more numbered hexagons could be generated. Arrays could be generated having any desired periphery or shape. Regardless of the shape or number of internal polygons the same principles to play a game would be employed.

Focusing on FIGS. 4*a*, 4*b* and 4*c*, play of the game will now be illustrated.

FIG. 4*c* is a listing of numbers randomly drawn from those depicted in FIG. 2. As noted above, the numbers of FIG. 4*c* were randomly-selected or generated depending upon the mode of random number generation chosen. As the numbers are called, intersections having those numbers are marked in some fashion. For example, in FIG. 4*a* when the number "4" is called, all intersections having the number 4 were circled thereby removing them from play. These intersections are then removed from play. Analogously, all interstices with the number 5 are circled and removed from play when the number "5" is called or indicated on the computer-based game. The process continues until all intersections having the randomly-generated numbers thereabout are removed from play. As illustrated, the last listed number, 345, is circled and shown by arrow indicated "A".

Illustrative of play, assume that the number 35 were the next number chosen after those listed in FIG. 4*c*. As indicated by arrow "B", 35 appears on both FIGS. 4*a* and 4*b*. When the player having card 4*a* circles 35 (indicated at arrow B), that player has obtained a sixth intersection "rounder" whereas the player having card 4*b* has merely obtained a five intersection "rounder". In this instance, the player having card 4*a* prevails. This illustrates one preferred mode of play wherein blank vertices (that is, vertices not having numbers in association therewith) are skipped, or not counted, when computing the number of vertices to determine the winner.

Illustrating another rule and preferred method of play using the instant game card, assume the number called after 345 were 15. In FIGS. 4*a* and 4*b*, the three-line vertex with the number 15 by it is indicated by arrow C. If both the players having cards illustrated in FIGS. 4*a* and 4*b* remove 15 after it is called, the player having the card depicted in FIG. 4*b* wins because that player, in one move, has achieved circles on two adjacent hexagons. For a given move resulting in a tie, the player that completes the most circles is declared the winner.

Figure 5:
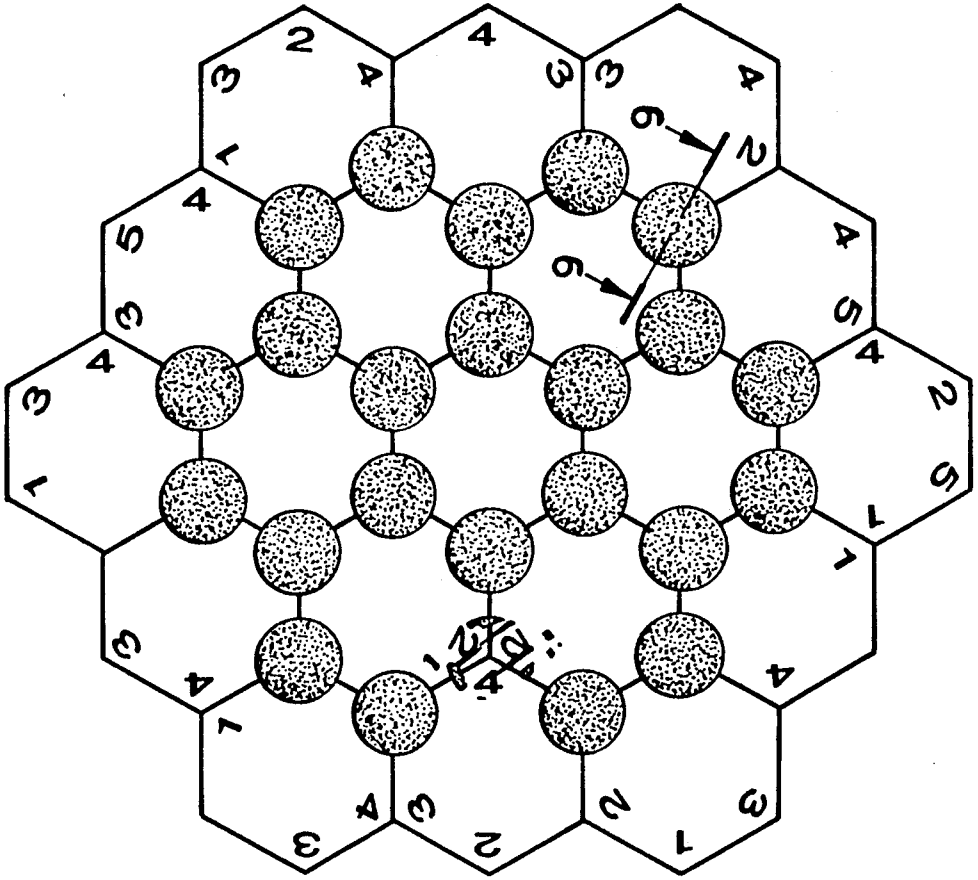
FIG. 5 is an embodiment of this invention using a removable opaque coating to hide a portion of the underlying matrix.

A method of utilizing the instant game card device in a promotion would likely employ an opaque but removable material on at least a portion thereof. FIG. 5 illustrates such a possible embodiment of the present game card in which an array such as that illustrated in FIGS. 4*a* and 4*b* is partially obscured by an opaque removable material. In this, utilization of this instant invention, it might be necessary that only three-line interstices be employed. It will be understood, however, that, while the designation of a particular three-digit number as a "winner" might be typical, the invention specifically contemplates one or two digit numbers serving as "winner" designations. Such "winner" designations would be met where one or two angle portions at an interstice are blank. For purposes of description, however, interstices having three digits will be discussed herein. This is illustrated in FIG. 5 by the two-line and three-line interstices having been left uncovered.

In this mode of play, a winning number is selected and made known. Participants then receive the game card of the present invention and select one, or a designated larger number of, interstices which may be uncovered by scraping the opaque material therefrom. As illustrated in FIG. 5, if the number 224 has previously been designated a "winner", then the holder of the promotional device having the game of the present invention with that designated intersection thereon has won. In order to avoid the possibility of fraud, the game array matrix would, of necessity, be made secure by employing a suitably thick substrate or paper backing or other means to prevent identification of the numbers beneath the blackened areas before the opaque material has been removed. It should be noted, in this preferred practice of the present invention, there are 24 non-peripheral interstices on each card. In order to increase the likelihood of winning, and therefore, the excitement associated with play, it may be necessary to designate several numbers as "winners" in order to obtain greater public interest in utilization of the present device.

Figure 6:
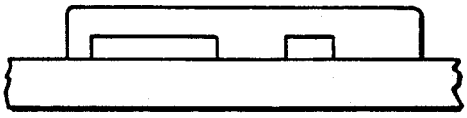
FIG. 6 is a cross-section view taken along line 6—6 of FIG. 5.

FIG. 6 illustrates an intersection of the present invention in exaggerated section. As is shown in FIG. 6, a substantially thick and light stopping substrate 2 has printed thereon a number 4 and, at least, a portion of the line of the array 6 covering both number 4 and matrix line 6 is an opaque but removable material 8. As is shown on the right side of FIG. 5 (at approximately three-o'clock) is an array of numbers 224 with opaque material partially removed therefrom.

Those of skill in this art will recognize many of the possible methods of utilizing the present number card game device. These variations and extensions of the present invention should be considered to be within the scope of the attached claims.

I claim:

1. A game card device comprising a matrix including a plurality of hexagons, each hexagon having translational symmetry, said matrix further having a generally closed perimeter, a plurality of lines defining the sides of said hexagons, said lines intersect forming two and three-line peripheral intersections on said perimeter, and forming three-line internal intersections insides said matrix, said intersections having corner areas, each corner area defined by the area between two intersecting lines wherein each two-line peripheral intersection having one corner area, each three-line peripheral intersection having two corners areas, and each three-line internal intersection having three corner areas; a plurality of numbers and blanks being randomly disposed on said corner areas, wherein each corner area either carrying a number or carrying a blank with no number between said lines.

2. A game card device comprising a matrix, the matrix comprising a generally closed perimeter, a plurality of intersecting lines forming two and three-line peripheral intersections on said perimeter, and said intersecting lines forming three-line internal intersections inside said matrix, said intersections having corner areas, each corner areas defined by the area between two intersecting lines wherein each two-line peripheral intersection having one corner area, each three-line peripheral intersection having two corner areas, and each three-line internal intersecting having three corner areas, a plurality of number and blanks being randomly disposed between said lines on said corner areas, wherein each corner area either carrying a number of carrying a blank with no number at lest a portion of said device being covered by removable opaque coating.

3. A game card device according to claim 2 wherein non-peripheral portions of said interstices are covered by removable opaque coating.

4. A game car comprising a generally planar surface having a matrix printed thereon, said matrix including a plurality of polygons interfitted to define a multiplicity of interstices formed by adjacent angular portions of contiguous polygons, a plurality of numbers and blanks being randomly disposed on said angular portions, wherein each angular portion either carrying a number or a blank with no number.

* * * * *